US005475400A

United States Patent [19]

Sellers et al.

[11] Patent Number: 5,475,400

[45] Date of Patent: Dec. 12, 1995

[54] GRAPHIC CARD WITH TWO COLOR LOOK UP TABLES

[75] Inventors: Scott Sellers, Menlo Park; David Schmenk, San Francisco, both of Calif.

[73] Assignee: Media Vision Inc., Fremont, Calif.

[21] Appl. No.: 153,340

[22] Filed: Nov. 15, 1993

[51] Int. Cl.[6] ..... G09G 5/06

[52] U.S. Cl. ..... 345/155; 345/199

[58] Field of Search ..... 345/153, 155, 345/199

[56] References Cited

U.S. PATENT DOCUMENTS

| | | | |
|---|---|---|---|
| 4,654,720 | 3/1987 | Tozawa | 345/199 |
| 5,003,299 | 3/1991 | Batson et al. | 345/155 |

OTHER PUBLICATIONS

IBM Technical Disclosure Bulletin, "Inverse Video Look–Up Table for Graphics Display Systems", vol. 31, No. 8, Jan. 1989, pp. 269 and 270.

*Primary Examiner*—Jeffery Brier
*Attorney, Agent, or Firm*—Elmer Galbi

[57] ABSTRACT

The present invention provides a display subsystem which includes a frame buffer, a Digital to Analog Converter (DAC), a first color look up table and a second color look up table. The first color look up table is located in front of the frame buffer. The second color look up table is located between the frame buffer and the DAC. When the display subsystem receives a command that involves pixels from a Device Independent Bit Map (DIB) file, the translation table provided with the DIB is stored in the first color look up table. This translation table has a number of entries equal to the number of combinations available with the particular DIB format. For example, if the DIB has a one bit color format the first translation table has two entries one for each possible state of the color bits in the DIB. If the DIB uses a four bit color format the first table has sixteen entries, if the DIB uses an eight bit color format the table would have two hundred and fifty six entries, etc. The length of each entry in the first translation table conforms to the number of color bit planes in frame buffer. For example if the frame buffer accommodates twenty four bits for a true color display, each entry in the first translation table would have twenty four bits. The second color translation table is used to operate on the color bits which are read from the frame buffer. The second translation table translates the logical color information in the frame buffer into bits which generate the desired colors on the display.

2 Claims, 5 Drawing Sheets

GRAPHIC CARD WITH TWO COLOR LOOK UP TABLES

FIELD OF THE INVENTION

The present invention relates to computers and more particularly to display sub-systems for computers.

BACKGROUND OF THE INVENTION

In general the display sub-systems in present day work stations and personal computers include frame buffers and utilize bit mapped graphics. An electronic representation of the on-screen image is stored in the frame buffer. The image stored in the frame buffer is in effect a time-slice of what appears on the display screen and it can be updated at a relatively slow rate, but it is read out and sent to the screen dozens of times per second.

A central processing unit (CPU) and an operating system control the image being displayed by sending commands to the display sub-system. These commands cause new data to be stored in the frame buffer. Updating the frame buffer in effect updates the image that appears on the screen.

Present day video frame buffers store the color of each pixel in the image. The color information in the frame buffer is often described as consisting of "color planes". The number of color planes utilized in a system determines the "bit-depth", and hence the number of different colors that can be accommodated.

Systems termed "true color systems" have a color bit-depth of 24 bits. A true color system can store and theoretically display any one of 16,777,216 colors or hues. While true color systems are commercially available, many monitors can only display 262,144 colors which corresponds to a bit-depth of 18. Furthermore for displays used in general purpose applications 32,768 colors and in some cases 215 colors is adequate.

Many presently available graphic sub-systems provide a mechanism for translating colors specified by programs running on a system's CPU into the colors that can be displayed on the particular display screen connected to the system. The mechanism that is in general use is termed a "color look up table" or a CLUT. The color bits stored in the frame buffer operate as pointers to bits which determine which particular color in a color palette will in fact be displayed. Thus, the CLUT maps the colors specified by the color planes in a frame buffer into the particular colors which will in fact be displayed.

For example in a system where the frame buffer stores one byte (8 bits) of information for each pixel, and the display can show 262,144 different colors, the CLUT would have 256 entries, one for each possible combination of 8 bits. The CLUT could have 18 bits in each entry therefore accommodating 262,144 different colors or hues. The data stored in the CLUT would determine which particular one of the 262,144 possible hues would appear on the screen for each of the 256 possible combinations specified by the color bits stored in the frame buffer.

A block diagram of a present day personal computer or work station is shown in FIG. 1A. As shown the system includes a system unit 2 and a display 8. The system unit 2 includes a CPU 3, an operating subsystem 4, a display subsystem device driver program 5, and a display subsystem card 6. The operating system 4 communicates with the display subsystem through the device driver 5. One example of the type of system shown in FIG. 1A is the type of system often termed an IBM compatible personal computer. The operating system 4 could for example be the "Windows 3.1" operating system marketed by Microsoft Corporation of Redmond Wash.

A block diagram of the graphic card 6 (i.e. the graphic subsystem) is shown in FIG. 1B. The card 6 connects to the CPU 3 in the system unit 2, via connectors 10 which are located on the end of the card 6. The CPU 3 or more particularly the operating system 4 sends commands to the device driver 5 which in turn sends them to the display subsystem via connectors 10. The commands from the device driver 5 are stored in registers 12. Logic 13 decodes and responds to the commands stored in registers 12 and stores information in VRAM frame buffer 14. Information is repeatedly read out of the VRAM buffer by refresh circuit 15 which sends signals to the display 8 via cable 7. As each pixel position in the frame buffer 16 is addressed, the color bits are used to address a location in the CLUT 16. The addressed location in CLUT 16 provides a value to DAC 18 which generates an analog signal which generates the particular color on the display.

When the system is first initialized, the device driver 5 loads the CLUT 16 with what is often termed a palette. The CLUT 16, operating according to the palette that is loaded at initialization time, translates subsequent color data from VRAM 14 into colors required by display 8.

Several different type of bit map file formats have become de-facto standards. The two which are relevant to the present invention are termed "Device Independent Bit Maps" and "Device Dependent Bit Maps". Files which use the Device Independent Bit Map format are generally called DIB files. When the operating system sends a command to the graphic system's device driver 6, the operating command specifies whether or not the command relates to a DIB file. If the command does relate to a DIB, a translation table is also sent to the device driver so that the logical colors specified in the DIB can be translated to actual colors required by the systems display, Furthermore the pixels in a DIB can have any one of four different color formats, namely, one, four, eight or twenty four bits. The device driver must translate the one, four, eight or twenty four bit format used by the particular DIB into the format used by the particular display sub-system. For example, if a DIB uses an eight bit format and the display is a true color display which uses a twenty four bit color format, the device driver must translate the color information associated with each bit in the DIB from eight to twenty four bits. The device driver must also either perform the translation specified by the translation table which accompanies the DIB or the device drive must reload the CLUT in the display subsystem. These processes which must be performed by the device driver can be very time consuming.

The present invention is directed to facilitating the execution of DIB files which are provided to a video sub-system for execution.

SUMMARY OF THE INVENTION

The present invention provides a display subsystem which includes a frame buffer, a Digital to Analog Converter (DAC), a first color look up table and a second color look up table. The first color look up table is located in front of the frame buffer. The second color look up table is located between the frame buffer and the DAC. When the display subsystem receives a command that involves pixels from a Device Independent Bit Map (DIB) file, the translation table provided with the DIB is stored in the first color look up table. This translation table has a number of entries equal to the number of color combinations available in the particular DIB format. For example, if the DIB has a one bit color format the first translation table has two entries one for each possible state of the color bits in the DIB. If the DIB uses a four bit color format the first table has sixteen entries, if the DIB uses an eight bit color format the table would have two hundred and fifty six entries, etc. The length of each entry in the first translation table conforms to the number of color bit planes in frame buffer. For example if the frame buffer accommodates twenty four bits for a true color display, each entry in the first translation table would have twenty four bits. The second color translation table operates on the color bits which are read from the frame buffer. The second translation table translates the logical color information in the frame buffer into bits which generate the desired colors on the display.

DETAILED DESCRIPTION OF A PREFERRED EMBODIMENT

Figure 1A:
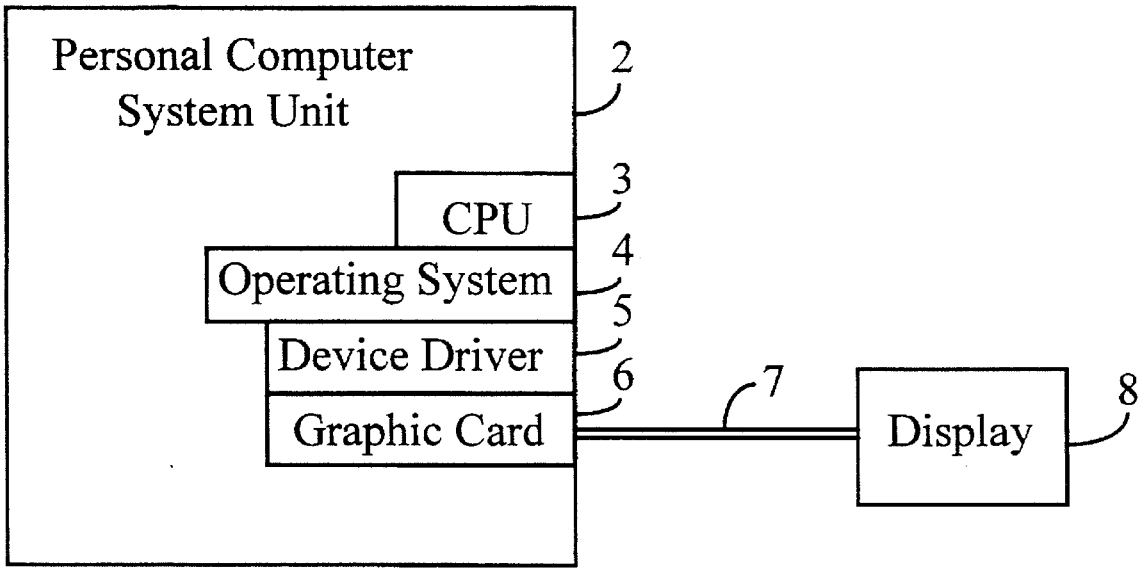
FIG. 1A (prior art)
FIGS. 1A and 1B are diagrams showing the prior art.
Figure 1B:
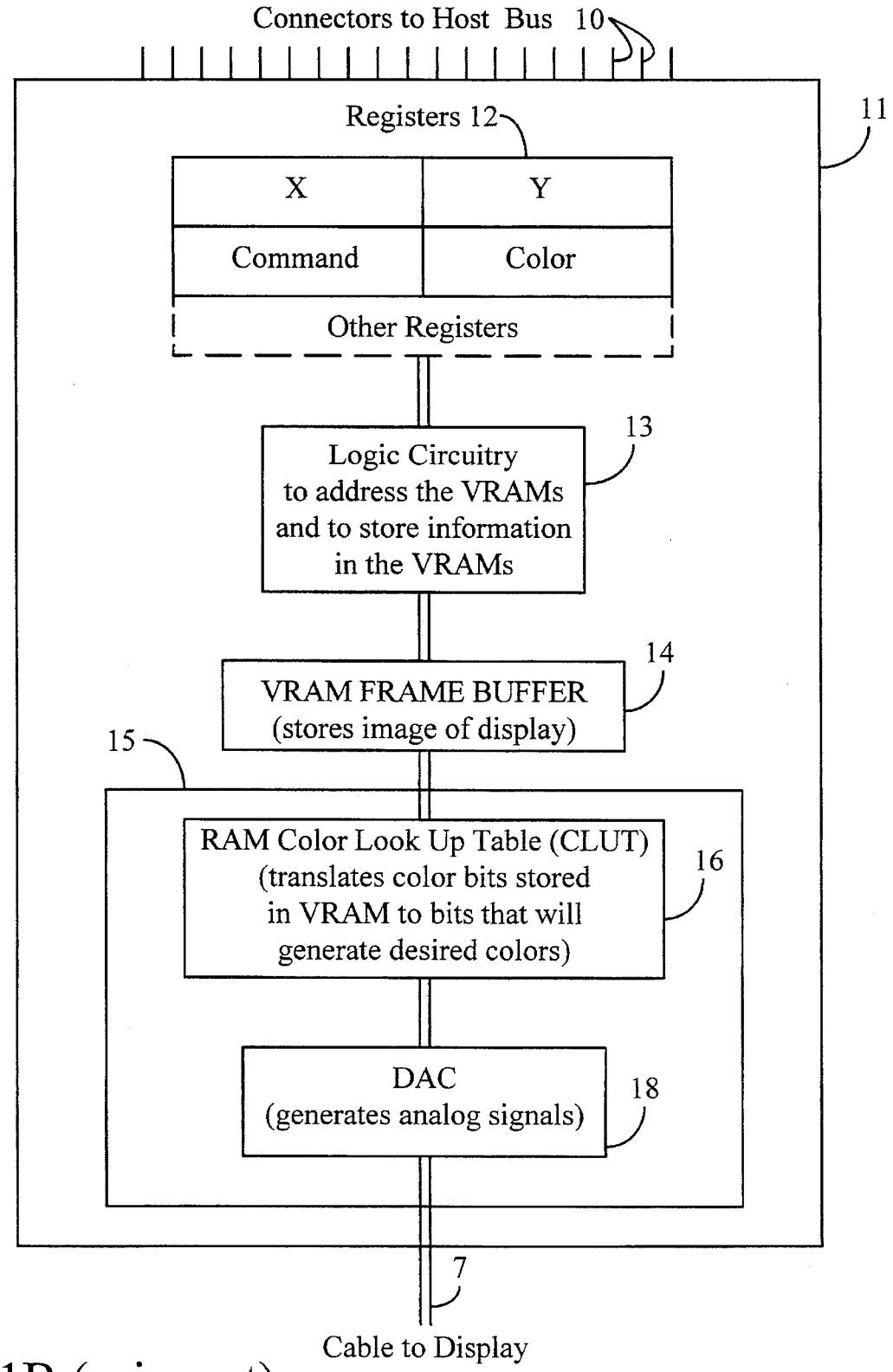
FIG. 1B (prior art)
Figure 2A:
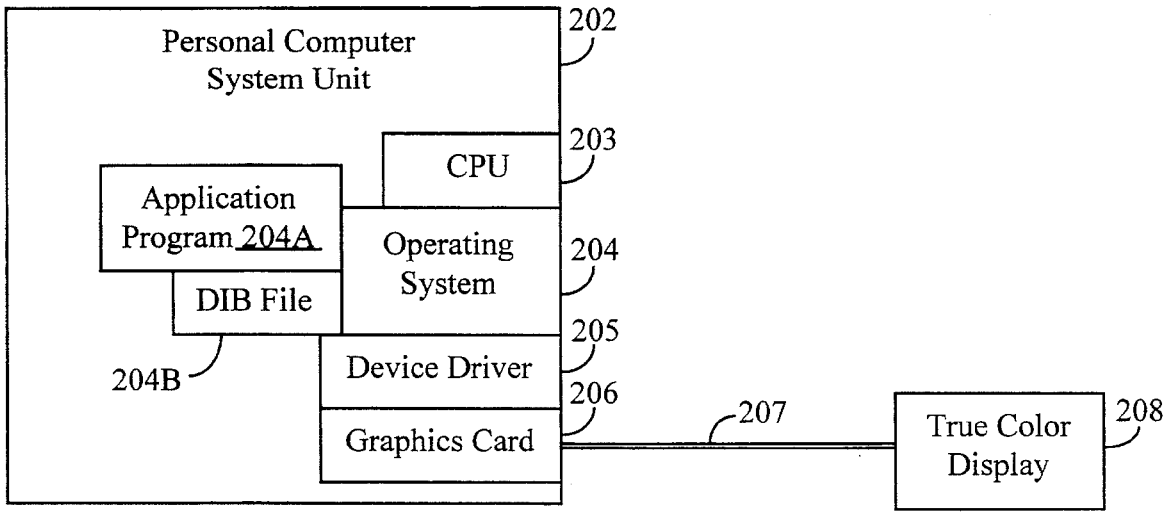
FIG. 2A is a an overall diagram of a preferred embodiment of the present invention.

FIG. 2A is an overall block diagram of a preferred embodiment of the present invention. A personal computer system unit 202 is connected to a true color display 208 via a graphics card 206 and a cable 207. The personal computer 202 includes a CPU 203, an operating system 204, a device driver 205 and a graphics card 206. The system 202 is running an application program 204A which has a DIB file 204B. For the purpose of illustration and to show the operation of the invention, in the first specific example discussed herein, DIB file 204B is an Audio Visual Image (AVI) file which specifies the color of each pixel using eight bits. Naturally it should be understood that application program 204A can take the form of any of the application programs that normally operate on personal computers.

Figure 2B:
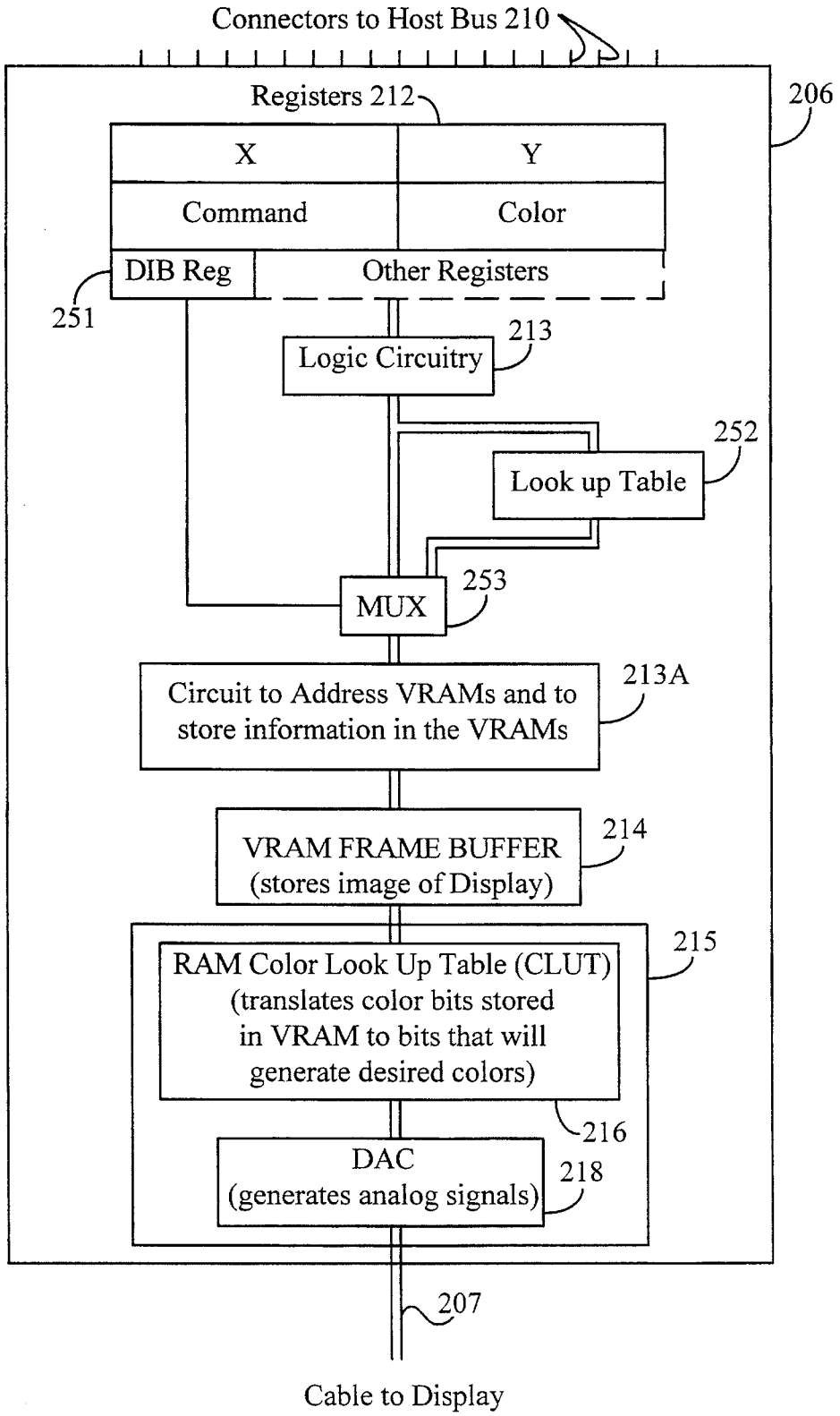
FIG. 2B is a block diagram of the graphic card used in the preferred embodiment of the present invention.

FIG. 2B is a block diagram of graphics card 206. The card includes registers 212, logic 213, look up table 252, multiplexer (MUX) 253, VRAM addressing circuit 213A, VRAM frame buffer 214, and refresh circuitry 215. Refresh circuitry 215 includes look up table 216 and Digital to Analog Converter (DAC) 218. Registers 212 include normal X, Y data register, command registers, color registers, etc. and a special register 251. Special register 251 stores a bit which indicates if the card is operating on data from a DIB file.

The registers 212 (other than register 251), the logical circuitry 213, the VRAM addressing circuitry 213A, the VRAM frame buffer 214, and the refresh circuitry 215 are conventional and they operate in the normal manner as does similar circuitry in the prior art. Such circuitry is available in commercially available graphic cards. Furthermore such circuity may include advanced features not shown or described herein. For example, the frame buffer 214 could include three way interleaving of the type shown in co-pending application Ser. No. 08/092,702 filed Jul. 16, 1993 and which is assigned to the assignee of the present invention.

The operation of DIB register 251, look up table 252 and multiplexer 253 will now be explained. When the graphics 206 card is operating on information from a DIB file, the bit stored in register 251 is set to "1" and any color bits sent to graphics card 206 are translated by use of look up table 252, prior to the time the bits are stored in frame buffer 213. The look up table 252 performs two functions. First it provides color translation as specified by the DIB file being operated upon. Second it handles color expansion, that is, it translates from the number of color bits used by the DIB file to number of color planes in the VRAM frame buffer 214. When the bit in register 251 is set to "1" multiplexer 253 passes the output of translation table 252 to the VRAMS, otherwise, the output of logic circuitry 213 goes directly to the frame buffer 214. Look up table 214 is conventional in construction, that is, the input from circuit 213 addresses a location in the table and the content of the addressed location is passed to multiplexer 253.

When a DIB file is being operated upon table 253 performs color expansion. For example, if DIB file 204A which is being displayed on display 208 utilizes a format with eight bits to specify color, each pixel displayed may have any one of 256 colors. The display 208 shown in FIG. 2A is a true color display which requires twenty four bits of information for each pixel. Furthermore frame buffer 214 has twenty four color planes, that is in frame buffer 214, twenty four bits are used to specify the color of each pixel. In this situation table 252 would be loaded with 256 entries, one for each possible color specified by the color bits from DIB file 204B. Each entry in tabled 252 has twenty four bits. When eight bits of color information are received from the DIB file, they are translated into twenty four bits which are stored in VRAMS 214 and used by display 208.

As shown herein display 208 is a true color display requiring twenty four bits of color information and frame buffer 214 stores twenty four bits of color information for each pixel. It is noted that DIB files can have 1, 4, 8 or 24 color bits for each pixel. Where the graphic card 206 is operating on information from a DIB file with one bit of color information it would be initialized with two entries, one for each color state. Each entry would be twenty four bits long to conform the number of color planes in the frame buffer. The table below shows how many values are stored in the color look up table 214 for each type of DIB file.

| Number of Color Bits per pixel in DIB File | Number of entries in Table 252 | Number of bits in each entry in Table 252 |
|---|---|---|
| 1 | 2 | 24 |
| 4 | 16 | 24 |
| 8 | 256 | 24 |
| 24 | 262,144 | 24 |

It is noted that in order to save cost, the size of table 214 could be limited to 256 entries. In this case when the DIB file being executed was a file with 24 color bits per pixel, translation table 214 would be rendered inoperable, i.e. the bit in register 251 would be set to zero by device driver 205. Alternatively, if table 214 has sufficient size to accommodate 262,144 entries, the bit in register 251 could be set to 1 when a DIB file with twenty four bits is being operated upon and the table 214 would provide color mapping but it would not in this case provide color bit expansion. It is noted that the bit in register 251 is also set to zero when bit from a file which has a Device Dependent Bit Map is being operated upon.

If the operating system 204 is the "Windows 3.1" operating system marketed by Microsoft, the CLUT 216 is loaded by a "set palette" command issued by Windows when the system is initialized. When Windows sends what is called a "SetDIBitsToDevice" command to device driver 205, the command specifies a location in memory of a conversion translation table called LPINT. This is explained in the Windows reference manual. The device driver 205 accesses the location specified by the "SetDIBitsToDevice" command and transfers the CLUT to the look up table 252. The bit in register 252 is also set to "1". Thereafter while the SetDIBitsToDevice command is being executed, information being stored in the VRAMS 214 is first translated by use of look up table 252.

Figure 3:
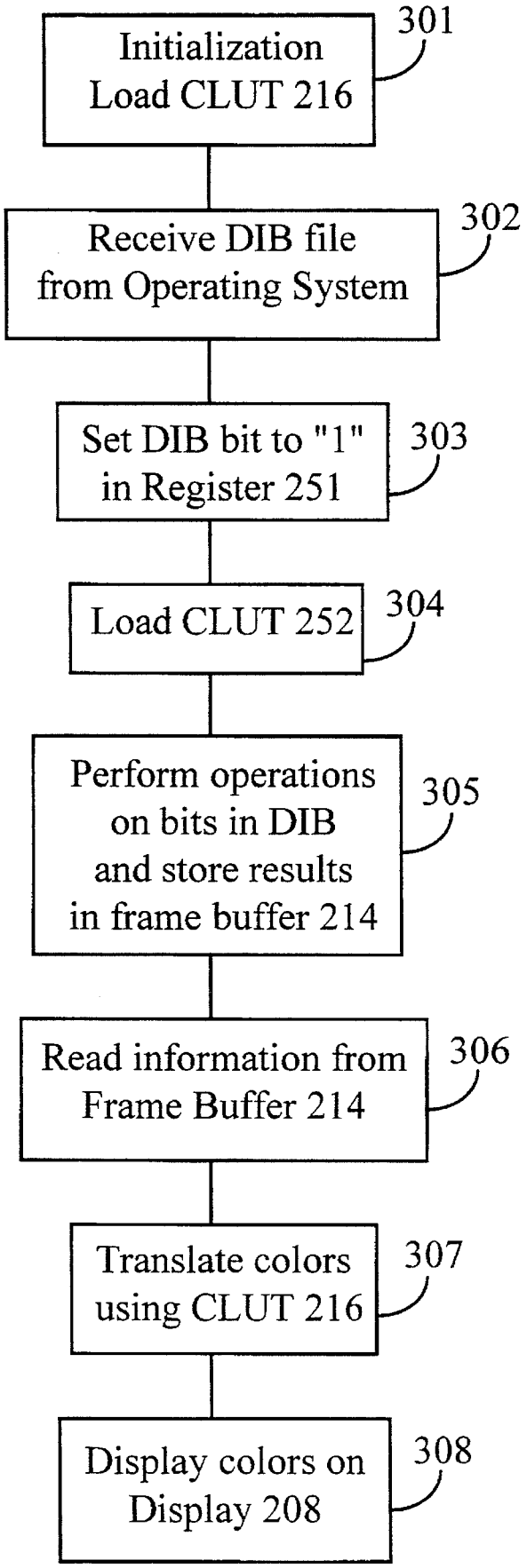
FIG. 3 is a flow diagram of the operations performed by the device driver when operating with the present invention.

FIG. 3 is a flow diagram showing the steps that occur when the operating system 204 is the "Windows 3.1" operating system. As indicated block 301, when Windows is initialized it issues a Set Palette command and transfers to device driver 205 a color palette which takes into account the type of display card in the system and the type of display attached to the system. The device driver 205 loads this table into color look up table 216. Next, in the process being illustrated in FIG. 3, it is assumed that an application program causes the operating system to send a DIB file to device driver 205 with a command which changes the information displayed on screen 208. The device driver 205 would set the bit in register 251 to "1" (block 303) and then load the table 252 with the conversion-translation table (block 304) specified by the command from the Windows operating system. Next the device driver 205 would instruct the graphics card 206 to perform the specified operation; however, instead of sending information directly from logic 213 to the frame buffer, the information would be directed through translation table 252 (block 305). Next in the normal sequence the information is read from the frame buffer (block 306) passed through the translation table 216 (block 307) to convert the logical colors to the colors recognized by the hardware and finally (block 308) the colors would be displayed on screen 208.

It is noted that the examples given above relate to a system operating under the "Windows 3.1" operating system. The present invention will provide substantially the same advantages to a system operating under control of the OS/2 operating system which is marketed by the IBM Corporation. Furthermore, the invention is applicable to a system operating under the "Window NT" operating system which is commercially available from Microsoft Corporation. Windows 3.1, OS/2 and Windows NT all utilize DIB files and thus systems with any of those operating systems would achieve substantial performance improvements by utilizing the present invention. The advantages achieved with the present invention are particularly pronounced when a system is executing a DIB file which has a different number of color bits than does the frame buffer in the system's graphic subsystem.

While the invention has shown with respect to preferred embodiments thereof, a wide variety of changes in form and detail may be made without departing from the spirit and scope of the invention. The invention encompasses all embodiments thereof included within the scope of the appended claims.

We claim:

1. In a graphics card which includes a plurality of registers, logic to execute commands from said registers, a frame buffer with a particular bit configuration, a digital to analog converter, and an output translation table connected between the output of said frame buffer and said digital to analog converter, the improvement comprising an input translation table connected prior to the input of said frame buffer to convert input color data from one form to a second form, whereby said graphic card can rapidly execute files which have a different color bit configuration than the bit configuration of said frame buffer and means to enable said first translation table when said graphic card is operating on information from Device Independent Bit map (DIB) file and to disable said first translation table when said graphic card is not operating on information from a DIB file.

2. In a system that includes a central processing unit, and a display with a plurality of pixels, said display requiring a particular number of color bits per pixel, a graphics card connecting said central processing unit to said display, said graphics card including a frame buffer, first means for entering data in said frame buffer and second means for transferring data from said frame buffer to said display, a first color look up table in said first means and a second color look up table in said second means, whereby said first color look up table can be initialized when said system is first initialized and said second color look up table can be initialized when data from a DIB is being displayed, said system including means to enable said first translation table when said graphic card is operating on information from said DIB file and to disable said first translation table when said graphic card is not operating on information from said DIB file.

* * * * *